United States Patent [19]

Popham

[11] 4,208,884

[45] Jun. 24, 1980

[54] AIR DEFROST HOUSING

[76] Inventor: Edward V. Popham, 1334 Lake Asher Cir., Apopka, Fla. 32703

[21] Appl. No.: 899,256

[22] Filed: Apr. 24, 1978

[51] Int. Cl.[2] ..... F25D 21/10

[52] U.S. Cl. ..... 62/282; 62/263; 137/614.11

[58] Field of Search ..... 62/151, 152, 153, 154, 62/155, 156, 82, 263, 282, 448; 137/614.11, 875, 876; 165/17

[56] References Cited

U.S. PATENT DOCUMENTS

| | | | |
|---|---|---|---|
| 2,124,268 | 7/1938 | Williams | 62/115 |
| 2,188,811 | 1/1940 | Folsom | 62/129 |
| 2,265,634 | 12/1941 | Cumming | 62/102 |
| 2,466,876 | 4/1949 | Brouse | 62/116 |
| 2,525,868 | 10/1950 | Corhanidis | 62/129 |
| 2,543,494 | 2/1951 | Hartman | 62/2 |
| 2,712,737 | 7/1955 | Palmer | 62/129 |
| 3,115,017 | 12/1963 | Kocher et al. | 62/155 |
| 3,729,950 | 5/1973 | Astrom | 62/259 |
| 3,937,033 | 2/1976 | Beckwith et al. | 62/155 |
| 4,022,032 | 5/1977 | Nott | 62/499 |

*Primary Examiner*—Albert W. Davis
*Assistant Examiner*—Margaret A. Focarino
*Attorney, Agent, or Firm*—Roger L. Martin

[57] ABSTRACT

A housing for the low side evaporator coil of a refrigeration unit which housing is separately mounted on an exterior wall of a refrigerator compartment and which employs an energy saving air defrost system that, during a defrost cycle, draws ambient air into the housing from one end and discharges it from the other end after it flows past the frosted coil. The housing comprises a preformed unitary body section having opposite ends, a generally centrally located center chamber, a pair of generally cylindrically shaped valve chambers and associated dampers having conforming cylindrical wall sections generally located in the center of each end, and a pair of air passages extending at one end into each valve chamber and at the other end to the exterior. Easy access for servicing or the like is obtained, through a hinged door, to the refrigeration components which are slidably mounted within the center chamber of the body section.

2 Claims, 9 Drawing Figures

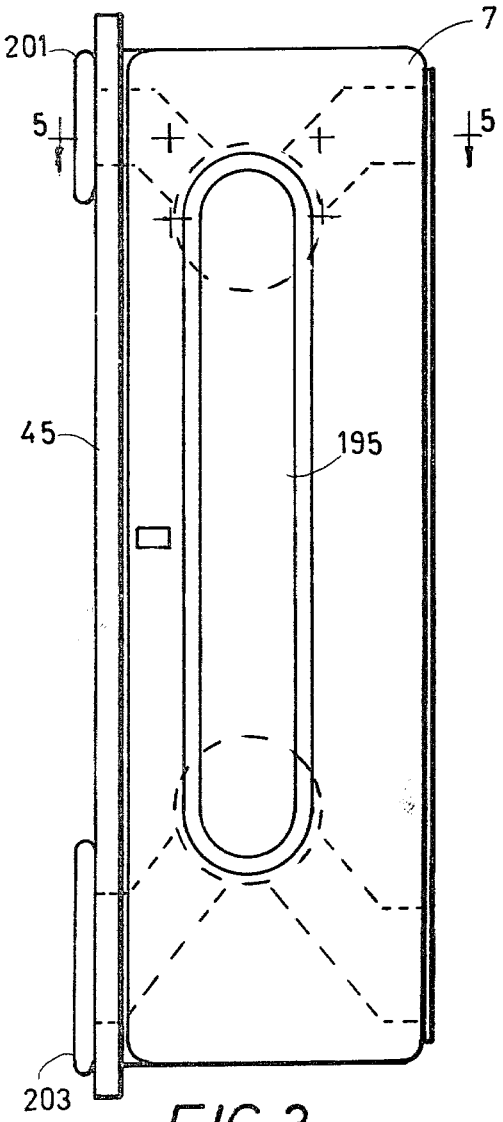
FIG. 3
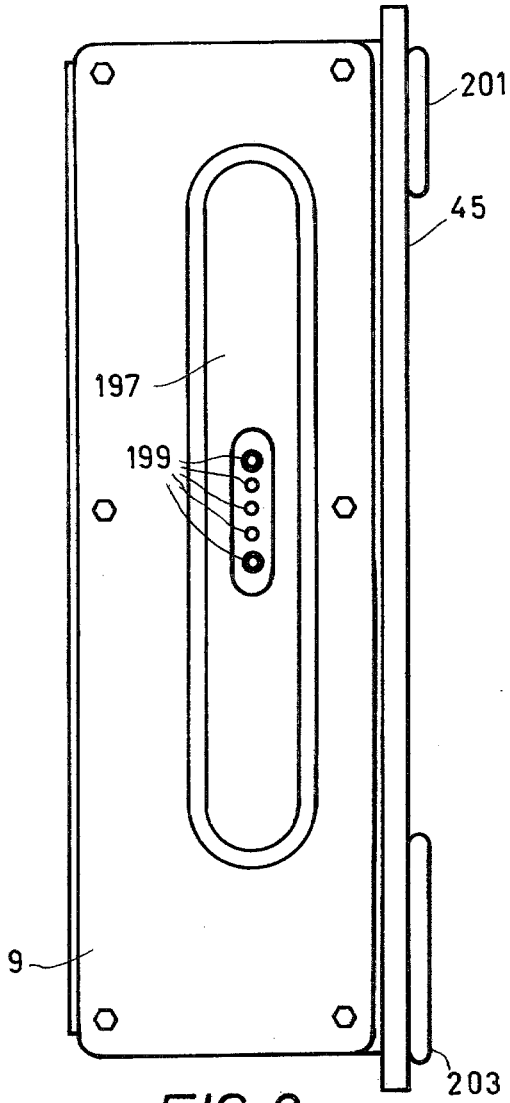
FIG. 2
FIG. 5
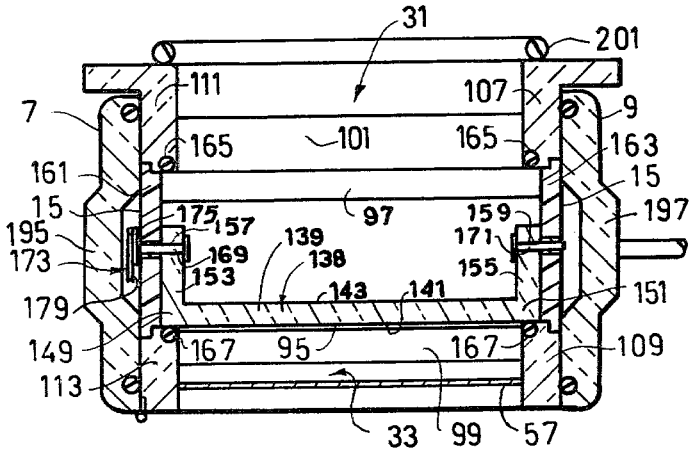

AIR DEFROST HOUSING

BACKGROUND OF THE INVENTION

The invention relates to improved refrigeration systems that have a housing for an evaporator which is equipped with a defrosting mechanism and adapted for mounting on an exterior wall of a refrigerator compartment.

Refrigerating systems having a detachable unit for installation in an opening in the side of a refrigerator are known. Such a system, as shown in U.S. Pat. No. 2,525,868, is relatively complex and expensive to manufacture. Its design requires two main sections, a body section within which the evaporator is mounted, and a frame section which is mounted within the opening in the sidewall of the refrigerator. This frame section is provided, in one embodiment, with shutters which are located in the ports of the refrigerator chambers wall within the frame section, and in another embodiment with shutters in the frame section as well as in the body section. During a defrost cycle such shutters are closed allowing the circulation of warm air from the outside to defrost its enclosed cooling unit. However utilization of such type of shutters is relatively thermally inefficient as well as being more complex in design and therefore more expensive to manufacture. Furthermore, in order to initiate a defrost cycle a single inspection door, which constitutes an exterior port, must be manually opened; also since this single port functions simultaneously as a warm air intake inlet and as an air discharge outlet, its thermal efficiency is reduced. Among its other disadvantages, such a system, not having a preformed, unitary main body section, is relatively more expensive to manufacture.

Refrigerator systems with a mechanism for defrosting a cooling unit located within the refrigerator compartment which utilizes ambient air are known. Such systems are not adapted to be utilized outside of said refrigerator chamber nor are they as simple and inexpensive to manufacture nor do they provide as efficient and relatively quick defrosting as compared to the unit embodying the present invention.

A refrigerator system with a mechanism for defrosting an evaporator coil located within a separate compartment which is integral with a refrigerator cabinet having another separate compartment used to store pershiables and which utilizes ambient air to defrost said evaporator is shown in U.S. Pat. No. 2,214,268. Among its several disadvantages is that it is not adaptable to be separately mounted on the storage compartment, it does not include a preformed unitary body section, and it is not adaptable to utilize slide-in components. Furthermore such a system is more expensive to manufacture, and its overall design is not as efficient in defrosting the evaporator coil located therein, all of which are primarily due to the totally different design approach used and implementation thereof.

SUMMARY OF THE INVENTION

A housing for the evaporator of a refrigeration unit which housing is adapted for mounting on an exterior wall of a refrigerator compartment comprising a preformed unitary body section having opposite side walls, a generally centrally located center chamber, a pair of cylindrical valve chambers communicating with and located at the opposite ends of the center chamber, and a pair of passages at each of the opposite ends of the body section and each of which communicate with its associated valve chamber and with the exterior of the body section. An arcuate valve member with a cylindrical wall section which includes an outer, arcuate, wall surface which conforms to the shape of the valve chamber, is located in each of the cylindrical valve chambers and serves as a component of an evaporator defrosting mechanism. Support means are provided within the center chamber for slidably mounting certain components including a air circulating fan motor unit, an evaporator unit, and a drain baffle and pan. The body section is closed off by a pair of side panels one of which is hinged to the body thereby enabling easy access thereto. A valve actuating component of the defrosting mechanism is connected to the air valves to selectively close off the passageways leading to the exterior while simultaneously opening the passageways leading to the refrigerator compartment, so that during a refrigeration cycle, air is drawn from the compartment, via one passageway, over the evaporator, further cooling said air, and then returning it, via another open passageway, to said refrigerator compartment. During the defrost cycle, the position of the air valves are reversed thereby sealing off the refrigerator compartment from ambient air now being drawn through one of the passageways leading to the outside and drawing the air over the evaporator coil, thereby defrosting it, and discharging the air out through the other open passageway.

The primary object of the present invention is to provide an inexpensive and efficient refrigeration unit which can be mounted on a refrigerator compartment wall.

Still another object of the present invention is to provide a refrigeration system that is ruggedly constructed and which is relatively simple and inexpensive to operate, service, install, and manufacture.

A further object of the present invention is to achieve greater usable refrigerator compartment space by providing a refrigeration unit which is mounted outside the compartment.

A still further object of the present invention is to provide an inexpensive refrigeration unit which efficiently utilizes free energy from ambient air during its primary defrost cycle.

Another object of the present invention is to provide a refrigeration unit, the components of which, can be easily and comfortably serviced outside the refrigerator compartment thereby decreasing servicing and or inspection time.

Still another object of the present invention is to provide an inexpensive, energy saving refrigeration unit which is mounted outside a refrigerator compartment and which eliminates the necessity of electric and/or hot gas defrosting.

An additional object of the invention is to provide an inexpensive and efficient refrigeration unit which can be separately mounted on all types of industrial and commercial refrigeration equipment used in low, medium and regular temperature applications.

The foregoing and various other objects, features and advantages of the invention will become more apparent and understandable as the description proceeds herein below, with reference taken to the accompanying drawings which illustrate, by way of example only, some preferred embodiments of the invention and in which like reference characters denote the corresponding parts of the several views.

BRIEF DESCRIPTION OF THE DRAWINGS

FIG. 2 is a right side elevational view of FIG. 1, taken along the line 2—2 of FIG. 1.

FIG. 3 is a left side elevational view of FIG. 1, wherein the passageways and valve chambers are shown in phantom, taken along the line 3—3 of FIG. 1.

FIG. 5 is a cross sectional view of FIG. 3 taken along the line 5—5 of FIG. 3.

DETAILED DESCRIPTION

Figure 1:
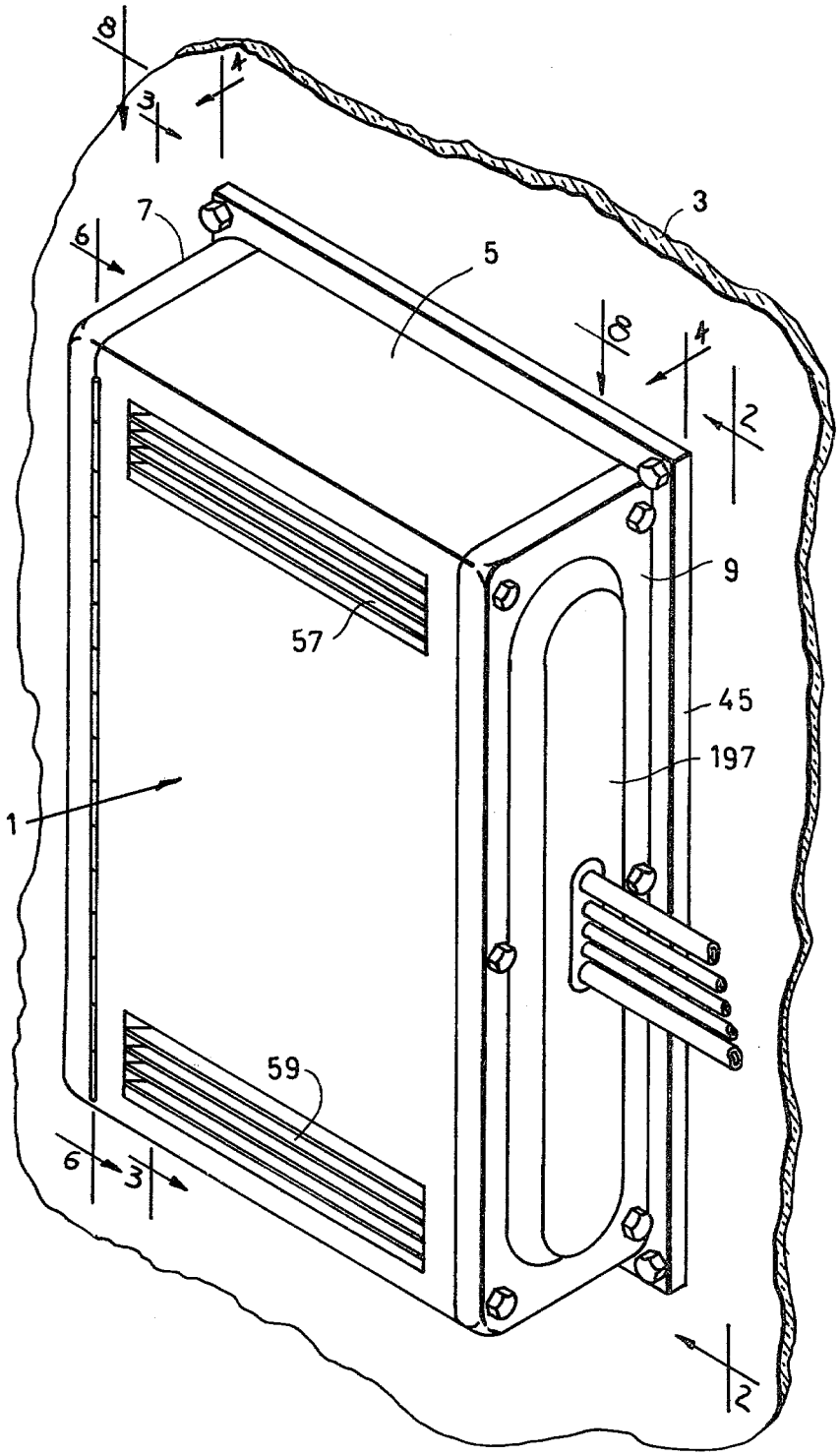
FIG. 1 is a front perspective view of the refrigeration unit embodying the present invention as seen from the exterior of a wall of a refrigerator compartment to which it is mounted.
Figure 7:
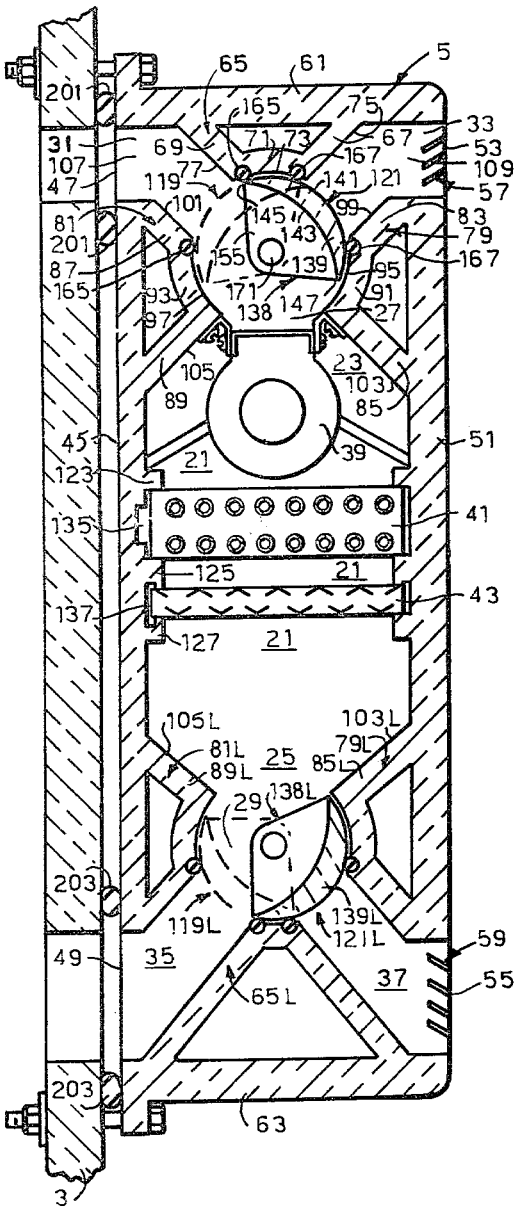
FIG. 7 is a simplified, longitudinal, vertical cross sectional view of FIG. 1 taken along the line 7—7 of FIG. 8, wherein the valve units shown in phantom view are positioned to close off the passages leading to the refrigerator compartment.
Figure 6:
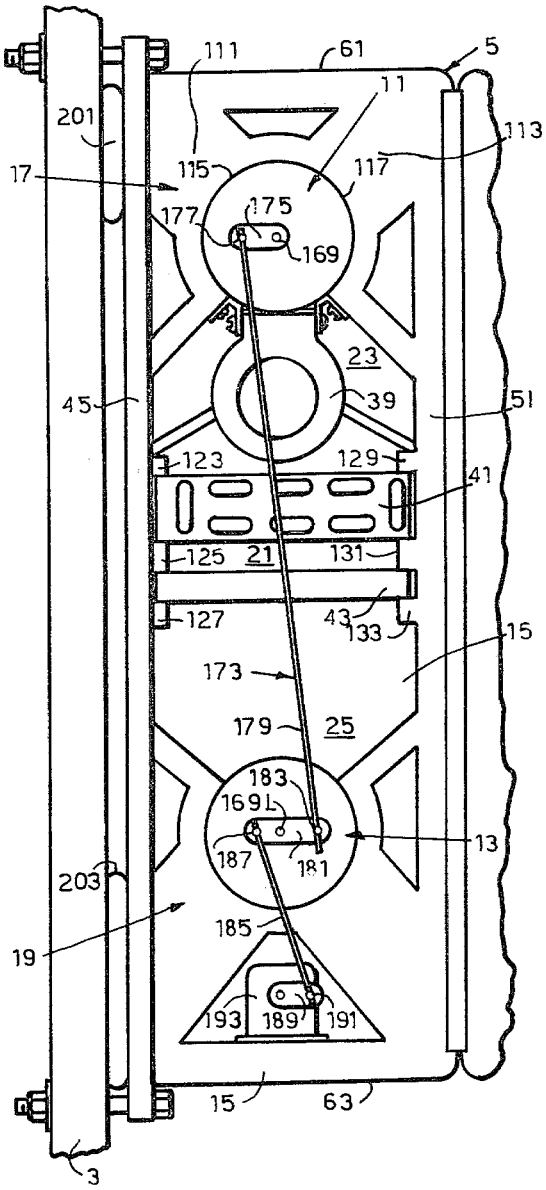
FIG. 6 is a left side elevational view of FIG. 1 taken along the line 6—6 of FIG. 1, wherein the hinged door is shown open.

Referring now to the drawings in detail, and in particular to FIGS. 1 and 6, the invention comprises a housing assembly, generally indicated as 1, preferably mounted vertically on the exterior wall 3 of a refrigerator compartment (not shown). The housing 1 comprises a preformed, unitary body section 5, of generally rectangular configuration, and a pair of generally rectangularly shaped closure means or opposite side panels 7 and 9. The housing serves to house an evaporator 41, a drain pan 43, an air circulating fan 39 and a defrosting mechanism that includes a pair of valve assemblies 11 and 13. Referring specifically to FIG. 6, the body section 5 has generally open, opposite side walls 15 only one of which is shown, the other being identical thereto, and opposite upper and lower end portions, the upper end portion generally being indicated at 17, and a lower end portion, generally being indicated at 19. A generally centrally located center chamber 21, is formed at about the middle of the body section 5 and has upper and lower opposite ends 23 and 25. Referring now specifically to FIG. 7, located at the opposite ends, 23 and 25, of the center chamber 21 are two generally cylindrical shaped valve chambers, an upper valve chamber 27 and a lower valve chamber 29. These valve chambers 27 and 29 are each also generally centrally located at the opposite ends 17 and 19 of the body section 5, respectively. Located at each of said opposite ends 17 and 19 of said body section 5 are a pair of generally rectangularly shaped air passages, upper passages 31 and 33, and lower passages 35 and 37, respectively, which radially extend from and communicate with the upper and lower valve chambers 27 and 29, respectively. Each individual air passage, 31, 33, 35 and 37, is located between the generally open ended opposite side walls 15, as best seen in FIG. 5, and each passage communicates with a valve chamber and with the exterior of the body section 5 through either of the front wall 51 or rear wall 45 of the body section as seen in FIG. 7. Referring now specifically to FIG. 7, slidably mounted and securely fastened to, support and mounting brackets, at the upper end 23 of the center chamber 21, is a conventional combined air circulating motor fan unit 39. Mounted below the motor fan unit 39 is a conventional evaporator unit or evaporator coil 41, and directly mounted below it is a conventional drain baffle and pan 43.

The body section 5 is preferably separately molded with an exterior and interior shell bonded to a foamed insulation core, discussed in more detail infra. The body section 5 comprises a generally rectangular shaped, vertical, rear sidewall 45 preferably having two generally rectangularly shaped openings or exterior ports, an upper opening 47 and a lower opening 49, respectively located at the opposite, upper and lower ends, of said rear sidewall 45. Spaced apart from the rear sidewall 45 is a similarly shaped, vertical, front sidewall 51 preferably having two generally rectangularly shaped openings or exterior ports, an upper opening 53 and a lower opening 55, respectively, located at the opposite upper and lower ends of said front sidewall 51. As the body section 5 is generally symmetrical with respect to a vertical plane through the center that is parallel to the front and rear walls, the upper exterior ports 47 and 53 at each end are oppositely disposed as are the lower exterior ports 49 and 55. Disposed within each opening 53 and 55 of front sidewall 51 are louvers 57 and 59, respectively, which function to prevent the entry of rain, leaves or other objects into the associated air passages 33 and 37. The body section 5 additionally includes an upper end wall 61 connected at its ends to the upper ends of said rear and front sidewalls 45 and 51, respectively, and a similar lower end wall 63 connected at its ends to the lower ends of said rear and front sidewalls 45 and 51, respectively. As the body section 5 is also generally symetrical along a horizontal plane through its center, only the internal structure at the upper end 17 thereof will be described; the ports used in the lower end 19 have the same reference numerals as those corresponding ports used in the upper end 17 with the suffix L added. The upper end 17 of the body section 5 includes a generally C-shaped internal portion 65 depending from the inner wall surface of upper end wall 61 and inwardly spaced from each of its ends. It comprises a pair of inwardly converging wall members, front wall member 67 and rear wall member 69, connected at their upper ends to the inner wall surface of upper end wall 61 and connected to their lower ends to the ends of a horizontally oriented, arcuate shaped, wall member 71 extending to the opening in said generally open ended opposite side ends 15, and whose inner wall surface 73 is concave shaped and wherein the inner wall surfaces 75 and 77 of said front and rear wall members 67 and 69, respectively, are planar. Laterally extending inwardly from each inner wall surface of the front and rear sidewalls 51 and 45, respectively, are identical, generally C-shaped internal portions 79 and 81, respectively. Each laterally extending internal portion 79 and 81 comprise a pair of inwardly converging wall members, 83 and 85, and 87 and 89, respectively, each pair, 83 and 85, and 87 and 89, connected at their exterior ends to the inner wall surfaces of front and rear sidewalls 51 and 45, respectively, and connected at their inner ends to the ends of generally vertically oriented arcuate shaped wall members 91 and 93, respectively, extending to the opening in said generally open ended, opposite side ends 15. Each of said arcuate shaped wall members 91 and 93 have an oppositely disposed inner wall surface 95 and 97, respectively, which is concave shaped. The upper wall members 83 and 87, and lower wall members 85 and 89, have inner wall surfaces 99 and 101, and 103 and 105, respectively, which are planar. These concave shaped inner wall surfaces 95, 97 and 73 form part of the upper valve chamber defining means, which define upper valve chamber 27. Each pair of upper air passages 31 and 33 are partially defined by the planar inner wall surfaces of upper wall members 87 and 83, the planar inner wall surfaces of rear and front wall members 69 and 67, and the inner, planar horizontal wall surfaces at the ends of upper end wall 61 and the planar horizontal edge portions of rear and front sidewalls, 45 and 51, respectively, and the exterior ends of said horizontal portions defining exterior ports 47 and 53. The first sides of each pair of said air passages 31 and 33 are defined by the inner wall surfaces of conforming doglegged end portions 107 and 109 (as best seen in FIG. 7), respectively, integral with said generally C-shaped internal portions 65, 79 and 81, and having conforming concave inner wall edge surfaces (not shown). The other, second sides of each pair of air passages 31 and 33, are not similarly shown, as they are identical to the said sides, and are defined by identical shaped end portions integral with said generally C-shaped internal portions 65, 79 and 81, but the outer wall surfaces 111 and 113 of said conforming end portions therefor are shown in FIG. 6, as are their conforming concave inner wall edge surfaces 115 and 117, respectively. Each of the upper air passages 31 and 33 includes a rectangular interior opening or port, 119 and 121, respectively, communicating with said upper valve chamber 27, and which, in cross section, are concave shaped. The arcs defined by said concave shaped interior ports 119 and 121 and said inner wall surfaces 95, 73 and 97 are all portions of the same circle, and define the major elements defining said upper valve chamber 27.

The center chamber 21 is generally defined by the inner wall surfaces 103 and 105 of wall members 85 and 89, respectively, at its upper, opposite end, and by the inner wall surfaces 103L and 105L of wall member 85L and 89L, respectively, at its lower, opposite end, and by the inner wall surfaces of front and rear sidewalls, 51 and 45, respectively, between the lower and upper ends of wall member 85 and 89, and 85L and 89L, respectively. Laterally extending from said inner wall surfaces of said front and rear sidewalls 51 and 45, and extending longitudinal between said generally open ended, opposite side walls 15, and oppositely disposed, are six mounting means, 123, 125, 127, 129, 131 and 133, for slidably mounting the fan motor unit's 39 support brackets and the ends of a horizontally oriented evaporator unit 41 and drain baffle and pan 43, one below the other, through either of the open ended sidewalls 15. Referring specifically to FIG. 7, recesses 135 and 137 are formed between said support means 123 and 125, and 125 and 127, respectively, to provide a first condensate drain in recess 135 when the housing assembly 1 is mounted horizontally the coil 41 then being vertically disposed and to provide another, second, condensate drain in recess 137 when said housing assembly 1 is vertically mounted. The first drain in recess 135 is conventionally connected internally to the second condensate drain in recess 137 to enable condensate to flow from the evaporator coil 41 when the housing assembly 1 is mounted horizontally. A motor fan unit 39 is mounted in the upper end of center chamber 21 by mounting brackets conventionally attached to the inner wall surfaces 105 and 103 of wall members 89 and 85, respectively, so as to cause a flow of air from the lower valve chamber 29 to the upper valve chamber 27. This air circulating fan 39 like the evaporator is adapted to be withdrawn from chamber 21 to the exterior of the body section through the opening in the body side wall 15.

The upper valve assembly 11 of the defrosting mechanism is identical to the lower valve assembly 13, except as specifically indicated infra, and the upper valve chamber 27 is identical in almost all respects to the lower valve chamber 29, and therefore a description of the upper valve assembly 11 and valve chamber 27 will suffice for both and corresponding parts for the lower valve assembly and chamber will carry the same reference numerals with the suffix L added. The upper valve assembly 11 comprises a frost free upper valve unit or valve means or damper 138 including a cylindrical wall section 139 having an outer and inner wall surface or face, 141 and 143, respectively, each having an arcuate shape with a common first and second end 145 and 147 and first and second side ends 149 and 151, as best seen in FIG. 5, and integral with each side end 149 and 151, of said cylindrical wall section 139, is end sectors 153 and 155, respectively, having a radial center apertures 157 and 159, respectively. Enclosing the ends of said upper valve chamber 27 and fixedly mounted on the opposite ends of said inner wall surfaces 95, 73 and 97, and the outer concave inner wall edges surfaces of conforming edge portions 111,113 and 107, 109, are two circular shouldered end plates 161 and 163, each having an aperture in the center, and whose outer surfaces are flush with the outer surfaces of the generally open ended opposite side ends 15. Conventionally mounted adjacent the periphery of each interior port, 119 and 121, and preferably within recesses formed in the inner wall surfaces 95, 73, and 97, are two conventional endless gaskets, 165 and 167, respectively, against which the outer wall face 141 of valve wall section 139 seats against. Alternatively a single endless gasket can be mounted within recesses formed in the face 141 of cylindrical wall section 139 of valve unit 138 near its ends 145 and 147. The upper arcuate valve member 138 is conventionally mounted for rotatable movement on the end shafts 169 and 171 which fit through its apertures 157 and 159, respectively, and the center apertures in end plates 161 and 163, respectively. The outer end of said end shaft 169 is connected to an assembly 173 that serves to link the arcuate valve members together in movement, as best seen in FIG. 6. The assembly 173 is located at the exterior of the body section between the side wall 15 and the side panel 7 and it comprises a laterally extending upper lever 175 fixedly connected at one end to the outer end of said end shaft 169 and having a rotatably mounted upper stud 177 which has a trasversely located aperture therethrough and which stud 177 is mounted at the other end of said upper lever 175 and extends perpendicularly outward. An upper elongated, generally vertically extending, connecting rod component 179 of assembly 173 is conventionally fixedly connected to said upper stud 177 through its aperture, as by the use of a set screw (not shown). The lower end of said connecting rod is connected in the same manner to a similar lower lever 181 through a lower stud 183 mounted thereon in the same manner as stud 177 is mounted on upper lever 175. The lower lever 181 is mounted near its midpoint for rotation with the outer end of end shaft 169L to which it is affixed. A shorter, lower connecting rod 185 serves to drivingly connect the motor 193 to the linking assembly and is connected at its upper end in the same manner to an identical stud 187 which is mounted on the lower level 181 in the same manner as stud 183 is mounted thereon. Similarly the lower end of lower connecting rod 185 is connected in the same manner to one end of a similar bottom lever 189 through a stud 191 mounted thereon in the same manner as stud 187 is mounted on lower lever 181. The other end of said bottom lever 181 is conventionally coupled to the output shaft of a conventional rotary actuating means 193.

Side panels 7 and 9, which are generally rectangular in shape, each have a formed, integral, elongated, raised central portion 195 and 197, respectively, on the exterior side, and a corresponding recessed portion on the interior side in order to provide surfficent space for said actuating assembly 173, clearance for the outer end of shaft 171, and room for wiring. Side panel 7 confronts the side wall of the body section and is conventionally hinged to the edge of front sidewall 51 and latched to the other side of the body section 5 in order to provide quick and easy access to said body section 5. Side panel 9 is secured to said body section 5 by conventional means such as a plurality of bolts connected to the edges of said front and rear sidewalls 51 and 45 which extend through appropriate openings in said side panel 9 and a corresponding number of nuts secured to the ends of said bolts. Each of said side panels 7 and 9 are conventionally gasketed on their inside wall surfaces so as to completely seal the perimeter of the side ends 15 of the body section 5. Another conventional securing means suitable for attaching side panel 9 to the body section 5 includes a slanted type compression bracket assembly for quick mounting with pull down bolts to assure an airtight seal.

A plurality of piping apertures 199, as best seen in FIG. 2 are formed in said raised central portion 197 of said side panel 9 in order to allow the necessary conventional piping to be connected to the evaporator unit 41 and drain baffle and pan 43 including a suction line (the input to the evaporator), a liquid line (the output line from the evaporator), and a drain line as well as an optional ethylene glycol input and return line (discussed infra).

Figure 4:
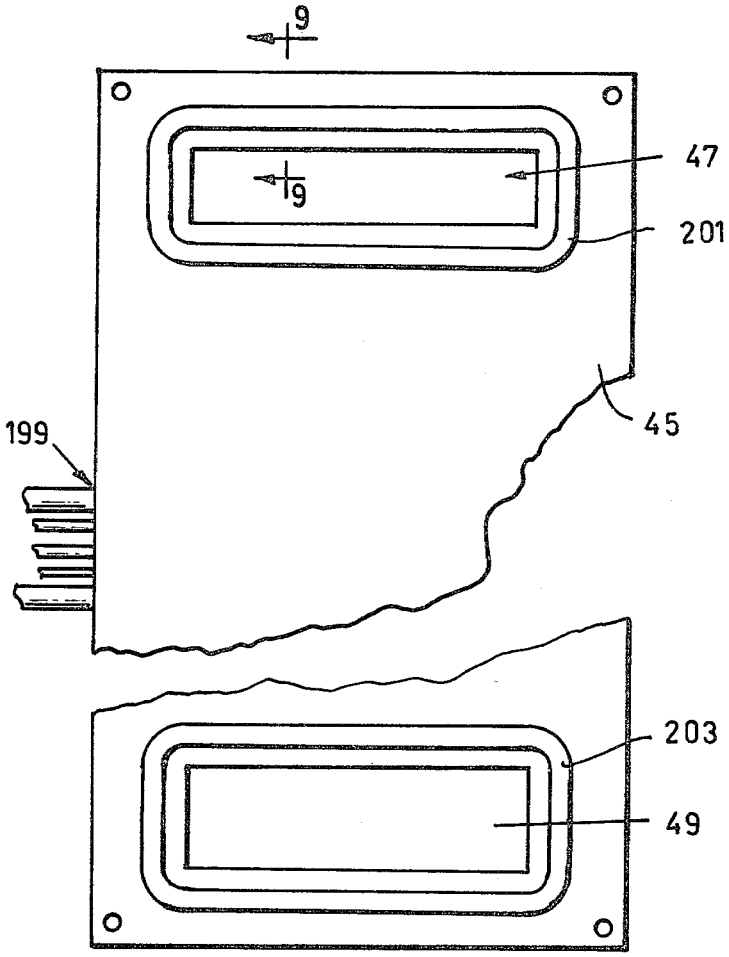
FIG. 4 is a rear elevational view of the refrigeration unit of FIG. 1 taken along the line 4—4 of FIG. 1.
Figure 8:
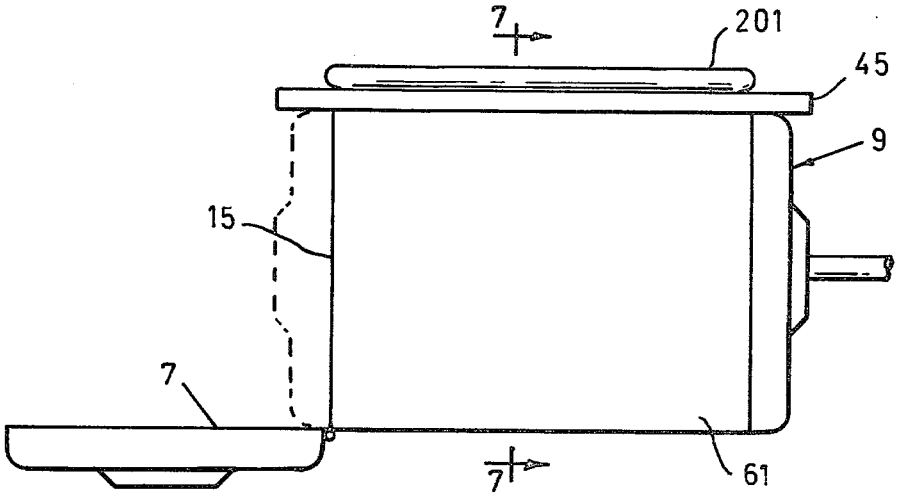
FIG. 8 is a top elevational view of FIG. 1 taken along the line 8—8 of FIG. 1.

The housing assembly's 1 rear sidewall's 45 exterior ports 47 and 49 are each completely gasket sealed there around by conventional gaskets 201 and 203, respectively, conventionally secured to the outer wall surfaces of said rear sidewall 45 as best shown in FIG. 4. The housing assembly 1 is preferably vertically mounted to the refrigerator wall 3 by conventional mounting means preferably connected through appropriate mounting holes in the flange portions at the four corners of said rear sidewall 45 and extending completely through said refrigerator wall 3 in such a manner that the exterior ports 47 and 49 efficiently communicate with appropriate sized matching openings formed in said refrigerator wall 3. Although vertical mounting of the housing assembly 1 to a vertical wall of a refrigerator compartment is specifically shown and preferred, said housing assembly 1 can be mounted horizontally on the roof or upper surface of the upper wall of said refrigerator compartment if that is desirable, and furthermore the housing assembly 1 is adaptable to be mounted below the floor or lower surface of the lower wall of said compartment if required. Accordingly, "wall" of a refrigerator compartment is intended to encompass the above described mounting positions.

Figure 9:
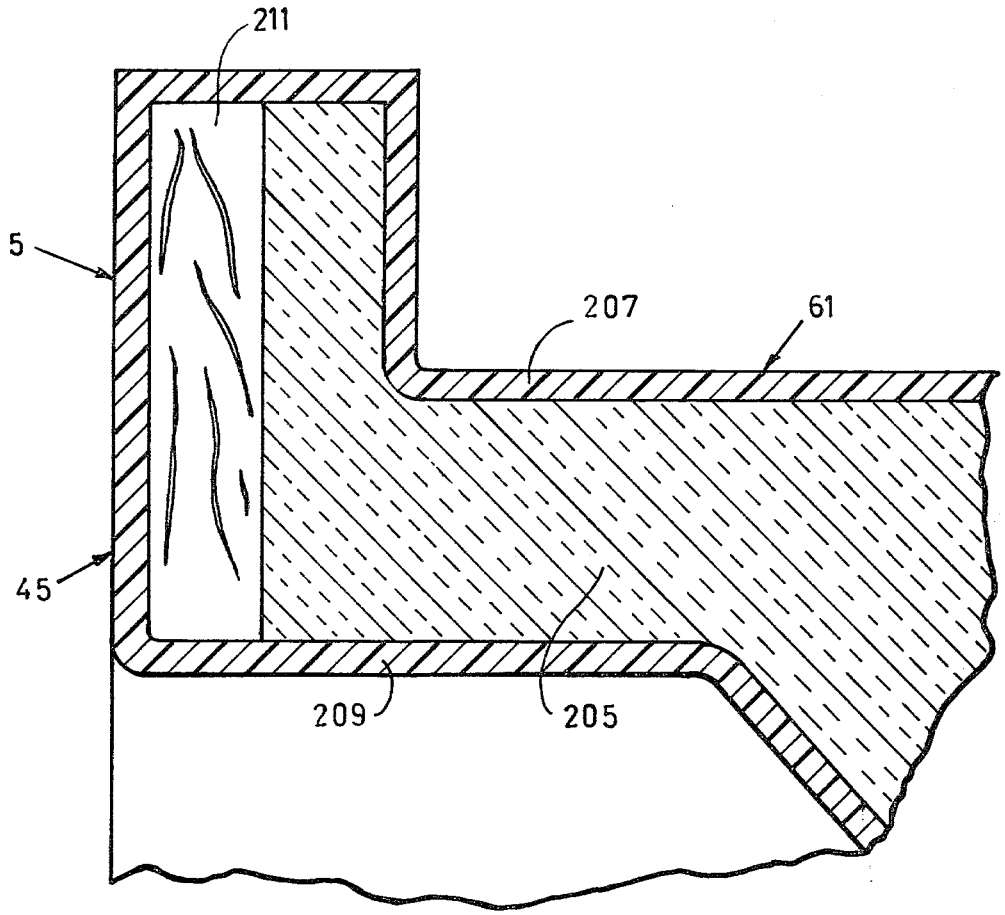
FIG. 9 is an enlarged, fragmentary cross sectional view of a portion of the upper end of the housing in FIG. 6, taken along the line 9—9 of FIG. 4.

Referring now specifically to FIG. 9, an upper corner portion of the body section's 5 construction is shown in detail, including rear sidewall 45 and upper end wall 61. The body section 5 is a separately molded component, as are the two side panel components, 7 and 9, and comprise an integral preformed interior core of insulation 205, preferably foamed urethane, to which an exterior shell 207 and interior shell 209 are conventional bonded to said exterior and interior wall surfaces, respectively, thereby forming a unitary section or component. Said shells are preferably formed of an appropriate type of fiberglass or polystyrene which can be easily bonded to foamed urethane. The construction of the two side panels 7 and 9 and the valve units 138 and 138L are the same as indicated supra for the body section 5. Only the body section 5, further includes a wooden base member 211, having the same shape as the rear sidewall 45, and which is sandwiched between said rear sidewalls 45 exterior wall face and said exterior shell 207, in order to provide additional structural strength.

The various generally trapezoidally shaped cavities formed within the body section 5 by the six generally C-shaped internal portions 65, 79, 81, 65L, 79L and 81L can be utilized as mounting compartments for housing and electrical controls including conventional automatic control and defrost circuitry for the various components mounted in the center chamber 21 in the same manner as the actuating means 193 is housed in the lowest cavity.

In operation, during the refrigeration cycle, the upper and lower valve units 138 and 138L, respectively, are positioned in their corresponding valve chambers 27 and 29, respectively, so as to fully close off interior ports 121 and 121L, respectively. Refrigerated air from the refrigerator compartment is drawn through the lower opening in refrigerator wall 3 and matching exterior opening or port 49 into air passage 35 and communicating lower valve chamber 29 wherein it is directed to the center chamber 21 by the action of recirculating fan motor unit 39. This air subsequently passes through the evaporator unit 41 which further cools it and then passes through the upper end 23 of said center chamber 21 to the upper valve chamber 27 where it is directed into air passage 31 through interior port 119 and finally discharged through exterior port 47 and the matching upper opening in the refrigerator wall 3 into said refrigerator compartment. During the defrost cycle, the upper and lower valve units 138 and 138L, respectively are positioned in their corresponding valve chambers 27 and 29, respectively, so as to fully close off interior ports 119 and 119L, respectively. Ambient air from the outside is recirculated through the evaporator unit 41 for defrosting it during said cycle while preventing such ambient air from entering the refrigerator compartment. Specifically, ambient air from the outside is drawn through the exterior intake port 55 into air passage 37 and communicating lower valve chamber 29 wherein it is directed to the center chamber 21 by the action of recirculating fan motor unit 39. This air subsequently passes through the evaporator unit 41 which warms and defrosts it and then passes through the upper end 23 of said center chamber 21 to the upper valve chamber 27 where it is directed into air passage 33 through interior port 121 and is finally discharged through exterior port 53 to the outside. The concave shape of the valve chambers 27 and 29 and the concave shape of the cylindrical wall section 139 and 139L, respectively, of the associated valve units 138 and 138L, respectively, results in the airflow being directed through the communicating air passages with a minimum pressure loss and low turbulence during either cycle.

When the housing assembly 1 is subject to low or extra low conditions in the horizontal plane a conventional low wattage blanket type heater element (not shown) can be placed in upper drain trough 135 and when energized during the defrost cycle will operate to eliminate any ice build up therein.

When the ambient air temperature is to low to utilize ordinary air defrosting an auxiliary heat reclaim fluid or solar heated fluid, such as ethylene glycol, may be circulated into the evaporator coil 41 through the previously referred to optional glycol lines from a storage tank (not shown) used as a back-up defrosting system for this refrigeration unit.

This refrigeration unit can be mounted on all types of industrial and commercial equipment including walk-in coolers, reach-in coolers or freezers, self-service food cases, refrigeration transport units, and the like.

While only certain preferred embodiments of this invention have been shown and described by way of illustration, many modifications will occur to those skilled in the art and it is, therefore, desired that it be understood that it is intended herein to cover all such modifications as fall within the true spirit and scope of this invention.

What is claimed as new and what it is desired to secure by Letters Patent of the United States is:

1. In a refrigeration system having an evaporator, a mechanism for defrosting the evaporator, a housing for the evaporator and mechanism which is adapted for mounting on an exterior wall of a refrigerator compartment, and a circulating fan for circulating air through the evaporator and compartment, the improvement wherein said housing comprises a preformed unitary body section comprising a rear wall which is adapted to facially confront the exterior wall of the refrigerator compartment, a front wall which is spaced apart from said rear wall, and a pair of opposite side walls that are spaced apart and formed integral with the front and rear walls, said body section having a chamber with upper and lower ends and which is centrally located between the front and rear walls and open to the exterior of the body section between said upper and lower ends at each of said opposite side walls, a pair of cylindrical valve chambers between said front and rear walls and which are respectively located above and below said centrally located chamber and communicate therewith at said upper and lower ends respectively, a first pair of passages that communicate with the respective valve chambers and with the exterior of the body section at said front wall, a second pair of passages that communicate with the respective valve chambers and with the exterior of the body section at said back wall, said evaporator being supported by the body section within said centrally located chamber and being adapted for withdrawal from said centrally located chamber to the exterior of the body section through the opening in one of said opposite side walls, said fan being mounted on the body section and being located and arranged within and at the upper end of said centrally located chamber for withdrawing air from the centrally located chamber and delivering it to the valve chamber thereabove, said fan being adapted for withdrawal from said centrally located chamber to the exterior of the body section through the opening in said one of said opposite side walls, said mechanism comprising a pair of arcuate valve members that are arranged in the respective valve chambers to close the respective passages of said first pair, said arcuate valve members being rotatably movable in the respective valve chambers to open the respective passages of said first pair and simultaneously close the respective passages of said second pair, means linking said arcuate members in movement, and means drivingly connected to the linking means and actuatable to simultaneously rotatably move said arcuate members.

2. In a refrigeration system having an evaporator, a mechanism for defrosting the evaporator, a housing for the evaporator and mechanism which is adapted for mounting on an exterior wall of a refrigerator compartment, and a circulating fan for circulating air through the evaporator and compartment, the improvement in accord with claim 1 wherein said linking means interconnects said arcuate members exteriorly of the body section at said one of said opposite side walls, and said housing comprises a pair of opposite side panels that are secured to the body section and respectively confront said opposite side walls, said linking means being located between said one of said opposite side walls and the one of said opposite side panels confronting said one side wall.

* * * * *